US007275838B2

(12) United States Patent
Casey

(10) Patent No.: US 7,275,838 B2
(45) Date of Patent: Oct. 2, 2007

(54) FIREPLACE LIGHTING SYSTEM

(76) Inventor: Robert W. Casey, 809 Sylvan Ave., North Versailles, PA (US) 15137

( * ) Notice: Subject to any disclaimer, the term of this patent is extended or adjusted under 35 U.S.C. 154(b) by 0 days.

(21) Appl. No.: 09/973,975

(22) Filed: Oct. 11, 2001

(65) Prior Publication Data

US 2003/0072159 A1 Apr. 17, 2003

(51) Int. Cl.

| | |
|---|---|
| ***F21L 4/02*** | (2006.01) |
| ***F21V 21/22*** | (2006.01) |
| ***F21S 8/00*** | (2006.01) |
| *F21S 10/04* | (2006.01) |

(52) U.S. Cl. ..... 362/184; 362/145; 362/250; 362/382; 362/432

(58) Field of Classification Search ..... 362/179, 362/180, 184, 188, 190, 191, 229, 232, 250, 362/269, 270, 285, 287, 422, 425, 431, 432, 362/440, 449, 450, 288, 145, 147, 382; 40/428; 126/500; 392/348

See application file for complete search history.

(56) References Cited

U.S. PATENT DOCUMENTS

| | | | | | |
|---|---|---|---|---|---|
| 953,425 | A * | 3/1910 | Miller | 362/217 |
| 1,010,101 | A * | 11/1911 | Weaver | 40/428 |
| 1,582,737 | A * | 4/1926 | Crawford | 126/500 |
| 1,901,294 | A * | 3/1933 | Gritt et al. | 40/428 |
| 2,285,535 | A * | 6/1942 | Schlett | 40/428 |
| 2,631,040 | A * | 3/1953 | Constantine | 40/428 |
| 2,942,829 | A * | 6/1960 | Stiffel | 362/431 |
| 2,965,751 | A * | 12/1960 | Stiffel | 362/395 |
| 2,979,605 | A * | 4/1961 | Meyerowitz | 362/227 |
| 3,378,003 | A * | 4/1968 | Scherer | 126/546 |
| 3,742,189 | A * | 6/1973 | Conroy et al. | 392/348 |
| 3,952,722 | A * | 4/1976 | Yamagishi | 126/553 |
| 4,838,240 | A * | 6/1989 | Rieger | 126/512 |
| 4,962,750 | A * | 10/1990 | Bridgewater | 126/503 |
| 5,099,591 | A * | 3/1992 | Eiklor et al. | 40/428 |
| 5,455,754 | A * | 10/1995 | Hoffner | 362/147 |
| 5,772,315 | A * | 6/1998 | Shen | 362/250 |
| 6,004,005 | A * | 12/1999 | Demshki, Jr. | 362/147 |
| 6,059,582 | A * | 5/2000 | Tsai | 362/287 |
| 6,431,730 | B1 * | 8/2002 | Deutsch et al. | 362/145 |
| 6,561,468 | B2 * | 5/2003 | Williamson | 248/146 |
| 2002/0084394 | A1 * | 7/2002 | Barrett | 248/261 |

* cited by examiner

*Primary Examiner*—Alan Cariaso
(74) *Attorney, Agent, or Firm*—James Ray & Assoc.

(57) ABSTRACT

The present invention provides a lighting system for illuminating an interior of a fireplace. The lighting system comprises a rod for securing the lighting system to an inner surface of such fireplace. A bracket member is engageable with the rod. There is a first means that is attached to the bracket member for providing illumination to the fireplace. The lighting system has a second means connected to the first means for providing the necessary power to such first means for providing illumination.

14 Claims, 1 Drawing Sheet

FIREPLACE LIGHTING SYSTEM

FIELD OF THE INVENTION

The present invention relates to fireplace lighting systems, and, more particularly, the present invention relates to a system of the lighting the interior of the fireplace.

BACKGROUND OF THE INVENTION

Fireplaces are very popular in todays housing market. From standard wood burning fireplaces to electric and gas fireplaces that simulate to visual effects of a real fireplace without all of the complications. Illuminating systems have also been used to make fireplaces more attractive. Electrical lighting circuits have been available to display a flickering effect.

It has also been a common practice to use a fireplace as a decorative part of a room. Any item which can enhance the appearance of a fireplace and make it more attractive is seen as a desirable feature.

SUMMARY OF THE INVENTION

Therefore the present invention provides a lighting system for illuminating an interior of a fireplace. The lighting system comprises a rod for securing the lighting system to an inner surface of such fireplace. A bracket member is engageable with the rod. There is a first means that is attached to the bracket member for providing illumination to the fireplace. The lighting system has a second means connected to the first means for providing the necessary power to such first means for providing illumination.

OBJECTS OF THE INVENTION

It is, therefore, one of the primary objects of the invention to provide an apparatus for illuminating the interior of a fireplace.

Another object of the present invention is to provide an adjustable means for securing the apparatus to the interior of the fireplace.

Yet another object of the present invention is to provide an apparatus that is relatively inexpensive to manufacture.

Still another object of the invention is to provide a means of illumination that can be changed to meet various color schemes.

In addition to the numerous objects and advantages of the present invention which have been described with some degree of particularity above, it should be both noted and understood that a number of other important objects and advantages of the lighting system will become more readily apparent to those persons who are skilled in the relevant art from the following more detailed description of the invention, particularly, when such detailed description is taken in conjunction with the appended claims.

Figure 1:
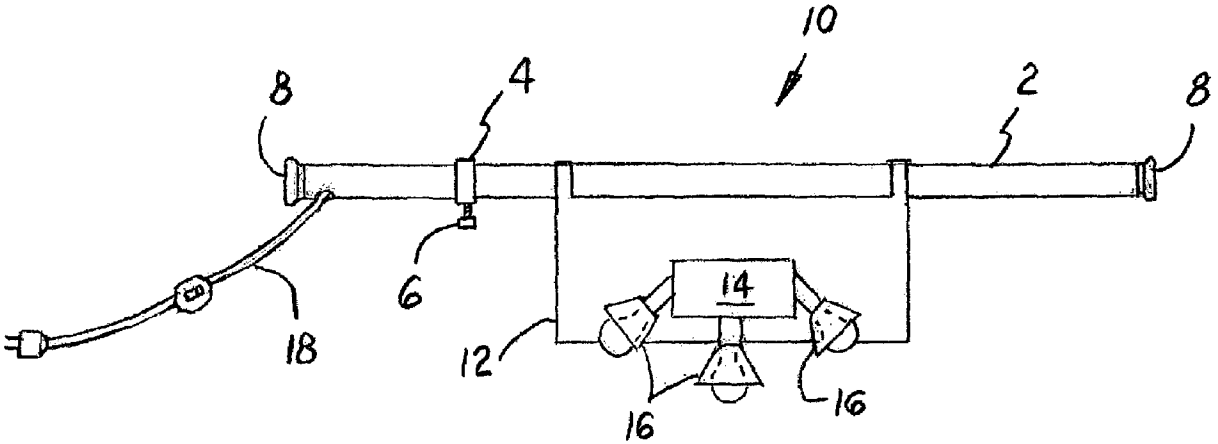
FIG. 1 is a partial perspective view of the apparatus for illuminating a fireplace according to one embodiment of the invention.
Figure 2:
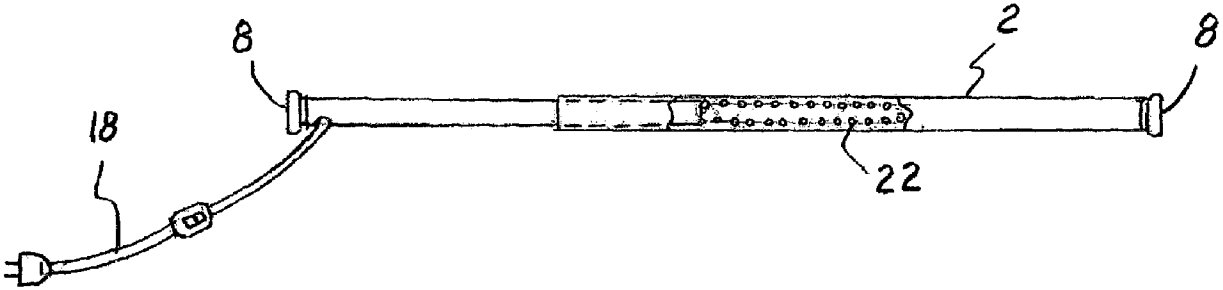
FIG. 2 is a partial perspective view of the expandable bar according to an alternate embodiment of the invention.

BRIEF DESCRIPTION OF THE PRESENTLY PREFERRED AND VARIOUS ALTERNATE EMBODIMENTS OF THE PRESENT INVENTION

Prior to proceeding to the more detailed description of the present invention, it should be noted that for the sake of clarity in understanding the invention, identical components with identical functions have been designated with identical reference numerals throughout the drawing Figures.

Illustrated in FIG. 1 is an apparatus, generally designated 10, for illuminating the inside of a fireplace. The apparatus 10 comprises an elongated bar 2. It is presently preferred that such bar 2 be an expandable bar so that the bar can engage the interior sides of the fireplace and secure the apparatus in place. By being adjustable the bar 2 can be made to conform to whatever the width of the fireplace. The bar can be expandable by having the end portions of the bar slide into the middle portion of the bar 2. A collar 4 is used to lock the bar 2 in place when it has expanded to the walls of the fireplace. A thumb screw 6 is used to hold the collar in place.

In an alternate embodiment of the invention, the bar is expandable by means being spring loaded 22. This would be similar to a rod for curtains or for a shower enclosure.

The expandable bar 2 further has pads 8 on each end of the rod 2. These pads protect the walls and further assist in preventing the rod from slipping when it secured to the walls. It is presently preferred that the pads 8 be made of an elastomeric composition and further, that the elastomeric composition be rubber.

A bracket 12 is engageable with the rod 2. As is clearly seen in FIG. 1 such bracket is disposed intermediate each end of such rod 2. A first means 14 is attached to bracket 12. Such first means 14 provides illumination for the apparatus 10. In a preferred embodiment of the invention such first means 14 includes a plurality of incandescent lamps 16. Although incandescent lamps are preferred it is within the scope of the invention that gas lights or lamps could be used. It is also presently preferred that three incandescent lamps 16 be used.

There is a second means 18 connected to the first means 14 for providing power to such first means 14. Such second means 14 is at least one of standard 110 volt electrical circuit, a battery an gas. It is presently preferred that such second means 18 be a standard 110 volt electric circuit.

Such second means 18 may also be provided with flashers which would permit the incandescent lamps 16 to twinkle or go on and off so as to provide a different effect. It is also within the scope of the invention that such incandescent lamps 16 may be of different colors. The lamps 16 could be red, green or whatever color the user chose to use for whatever effect was whatever color the user chose to use for whatever effect was desired.

While a presently preferred embodiment and alternate embodiments of the present invention has been described in detail above, it should be understood that various other adaptations and/or modifications of the invention can be made by those persons who are particularly skilled in the lighting art without departing from either the spirit of the invention or the scope of the appended claims.

I claim:

1. A lighting system for illuminating an interior of a fireplace, said lighting system comprising:

(a) a rod for securing said lighting system to each inner side wall surface of such fireplace, said rod having a first end and a second end;

(b) a bracket member engageable with said rod, said bracket member disposed intermediate said first end and said second end of said rod;

(c) a first means attached to said bracket member for providing illumination; and (d) a second means connected to said first means for providing power to said first means for illumination.

2. A lighting system for illuminating the interior of a fireplace, according to claim 1, wherein said second means is at least one of a standard 110 volt electrical circuit, a battery and gas.

3. A lighting system for illuminating the interior of a fireplace, according to claim 2, wherein said second means is at least one of a battery and a standard 110 volt electrical circuit.

4. A lighting system for illuminating the interior of a fireplace, according to claim 3, wherein said second means further includes a flasher arrangement for providing a twinkle effect.

5. A lighting system for illuminating the interior of a fireplace, according to claim 3, wherein said second means is a standard 110 volt electrical circuit.

6. A lighting system for illuminating the interior of a fireplace, according to claim 1, wherein said first means includes a plurality of incandescent lamps.

7. A lighting system for illuminating the interior of a fireplace, according to claim 6, wherein said incandescent lamps may be different colored lamps.

8. A lighting system for illuminating the interior of a fireplace, according to claim 1, wherein said rod is an expandable rod.

9. A lighting system for illuminating the interior of a fireplace, according to claim 8, wherein said expandable rod is spring loaded.

10. A lighting system for illuminating the interior of a fireplace, according to claim 8, wherein said expandable rod has mechanical means for providing expansion.

11. A lighting system for illuminating the interior of a fireplace, according to claim 10, wherein said mechanical means includes a collar and thumb screw arrangement to secure the rod for whatever expansion is desired.

12. A lighting system for illuminating the interior of a fireplace, according to claim 8, wherein said expandable rod further includes pads on each end of said expandable rod.

13. A lighting system for illuminating the interior of a fireplace, according to claim 12, wherein said pads are an elastomeric composition.

14. A lighting system for illuminating the interior of a fireplace, according to claim 13, wherein said elastomeric composition is rubber.

* * * * *